US007470355B2

(12) United States Patent
Osborn et al.

(10) Patent No.: US 7,470,355 B2
(45) Date of Patent: Dec. 30, 2008

(54) ELECTROCHEMICAL REDUCTION OF METAL OXIDES

(75) Inventors: Steve Osborn, Valentine (AU); Ivan Ratchev, Georgetown (AU); Les Strezov, Adamstown (AU); Greg Rigby, Shortland (AU)

(73) Assignee: BHP Billiton Innovation Pty Ltd (AU)

( * ) Notice: Subject to any disclaimer, the term of this patent is extended or adjusted under 35 U.S.C. 154(b) by 380 days.

(21) Appl. No.: 10/490,452

(22) PCT Filed: Dec. 12, 2003

(86) PCT No.: PCT/AU03/01657

§ 371 (c)(1),
(2), (4) Date: Aug. 16, 2004

(87) PCT Pub. No.: WO2004/053201

PCT Pub. Date: Jun. 24, 2004

(65) Prior Publication Data

US 2005/0050989 A1 Mar. 10, 2005

(30) Foreign Application Priority Data

Dec. 12, 2002 (AU) ..... 20029533282
Jun. 2, 2003 (AU) ..... 2003902741

(51) Int. Cl.
*C25C 3/26* (2006.01)

(52) U.S. Cl. ..... 205/401; 205/397; 205/398; 205/399; 205/400

(58) Field of Classification Search ..... 204/228, 204/242–243.1; 205/367–401
See application file for complete search history.

(56) References Cited

U.S. PATENT DOCUMENTS 4,188,462 A * 2/1980 Klootwyk ..... 429/68

(Continued)

FOREIGN PATENT DOCUMENTS

DE 150557 6/1903

(Continued)

OTHER PUBLICATIONS

"Studies in the Electrolytic Reduction of Titanium Dioxide and Titanium Slag", S. Takeuchi et al. Nippon Kinzoku Gakkaishi, vol. 28, No. 9, pp. 549-554 (circa 1964).

(Continued)

*Primary Examiner*—Nam X Nguyen
*Assistant Examiner*—Bach T Dinh
(74) *Attorney, Agent, or Firm*—Miles & Stockbridge P.C.; David R. Schaffer, Esq.; Patrick L. Miller, Esq.

(57) ABSTRACT

A process for electrochemically reducing a metal oxide, such as titania, in a solid state in an electrochemical cell that includes a bath of molten electrolyte, a cathode, and an anode, which process includes the steps of: a) applying a cell potential across the anode and the cathode that is capable of electrochemically reducing the metal oxide supplied to the molten electrolyte bath, b) continuously or semi-continuously feeding the metal oxide in powder and/or pellet form into the molten electrolyte bath, c) transporting the powders and/or pellets along a path within the molten electrolyte bath and reducing the metal oxide as the metal oxide powders and/or pellets move along the path, and d) continuously or semi-continuously removing metal from the molten electrolyte bath. Also disclosed and claims is an electrochemical cell for carrying out this process.

22 Claims, 3 Drawing Sheets

U.S. PATENT DOCUMENTS

| | | | | |
|---|---|---|---|---|
| 4,225,395 | A | 9/1980 | Tsang | |
| 4,362,610 | A * | 12/1982 | Carpenter | 204/263 |
| 5,286,353 | A * | 2/1994 | Wilkening | 205/378 |
| 6,299,742 | B1 | 10/2001 | Pal et al. | |
| 6,540,902 | B1 | 4/2003 | Redey et al. | |
| 2003/0047462 | A1 * | 3/2003 | Ward-Close et al. | 205/366 |
| 2003/0047463 | A1 * | 3/2003 | Ward-Close et al. | 205/538 |
| 2003/0173228 | A1 | 9/2003 | Strezov et al. | |

FOREIGN PATENT DOCUMENTS

| | | |
|---|---|---|
| GB | 2 359 564 A | 8/2001 |
| GB | 2 362 164 | 11/2001 |
| WO | WO 9964638 A1 | 12/1999 |

OTHER PUBLICATIONS

"Electrochemical Deoxidation of Titanium" Mellurgical Transactions B. vol. 24B, Jun. 1993 Okabe et al., pp. 449-455.

"Reduction of Titanium Dioxide by Calcium in Hot Cathode Spot" Oki et al., Memoirs of the School of Engineering, Nagoya University, vol. 19, No. 1 (1967).

* cited by examiner

ELECTROCHEMICAL REDUCTION OF METAL OXIDES

BACKGROUND OF THE INVENTION

1. Field of the Invention

The present invention relates to electrochemical reduction of metal oxides.

The present invention relates particularly to continuous and semi-continuous electrochemical reduction of metal oxides in the form of powders and/or pellets to produce metal having a low oxygen concentration, typically no more than 0.2% by weight.

The present invention was made during the course of an on-going research project on electrochemical reduction of metal oxides being carried out by the applicant. The research project has focussed on the reduction of titania ($TiO_2$).

2. Description of Related Art

During the course of the research project the applicant has carried out experimental work on the reduction of titania using electrochemical cells that include a pool of molten $CaCl_2$-based electrolyte, an anode formed from graphite, and a range of cathodes.

The $CaCl_2$-based electrolyte was a commercially available source of $CaCl_2$, namely calcium chloride dihydrate, which decomposed on heating and produced a very small amount of CaO.

The applicant operated the electrochemical cells at potentials above the decomposition potential of CaO and below the decomposition potential of $CaCl_2$.

The applicant found that at these potentials the cells could electrochemically reduce titania to titanium with low concentrations of oxygen, ie concentrations less than 0.2 wt %.

The applicant does not have a clear understanding of the electrochemical cell mechanism at this stage.

Nevertheless, whilst not wishing to be bound by the comments in the following paragraphs, the applicant offers the following comments by way of an outline of a possible cell mechanism.

The experimental work carried out by the applicant produced evidence of Ca metal dissolved in the electrolyte. The applicant believes that the Ca metal was the result of electrodeposition of $Ca^{++}$ cations as Ca metal on the cathodes.

As is indicated above, the experimental work was carried out using a $CaCl_2$-based electrolyte at a cell potential below the decomposition potential of $CaCl_2$. The applicant believes that the initial deposition of Ca metal on a cell cathode cell was due to the presence of $Ca^{++}$ cations and $O^{--}$ anions derived from CaO in the electrolyte. The decomposition potential of CaO is less than the decomposition potential of $CaCl_2$.

In this cell mechanism the cell operation is dependent on decomposition of CaO, with $Ca^{++}$ cations migrating to the cell cathode and depositing as Ca metal and $O^{--}$ anions migrating to the anodes and forming CO and/or $CO_2$ (in a situation in which the anode is a graphite anode) and releasing electrons that facilitate electrochemical deposition of Ca metal on the cathode.

The applicant believes that the Ca metal that deposited on the cathode participated in chemical reduction of titania resulting in the release of $O^{--}$ anions from the titania.

The applicant also believes that the $O^{--}$ anions, once extracted from the titania, migrated to the anode and reacted with anode carbon and produced CO and/or $CO_2$ and released electrons that facilitated electrochemical deposition of Ca metal on the cathode.

The applicant operated the electrochemical cells on a batch basis with titania in the form of pellets and larger solid blocks in the early part of the work and titania powders in the later part of the work.

The applicant also operated the electrochemical cells on a batch basis with other metal oxides.

Whilst the research work established that it is possible to electrochemically reduce titania (and other metal oxides) to metals having low concentrations of oxygen in such electrochemical cells, the applicant has realised that there are significant practical difficulties operating such electrochemical cells commercially on a batch basis.

Nevertheless, in the course of considering the results of the research work and possible commercialisation of the technology, the applicant realised that commercial production could be achieved by operating the electrochemical cell on a continuous or semi-continuous basis with metal oxide powders and/or pellets being transported through the cell in a controlled manner and being discharged in a reduced form from the cell.

SUMMARY OF THE INVENTION

According to the present invention there is provided a process for electrochemically reducing a metal oxide, such as titania, in a solid state in an electrochemical cell that includes a bath of molten electrolyte, a cathode, and an anode, which process includes the steps of: applying a cell potential across the anode and the cathode that is capable of electrochemically reducing metal oxide supplied to the molten electrolyte bath, continuously or semi-continuously feeding the metal oxide in powder and/or pellet form into the molten electrolyte bath, transporting the powders and/or pellets along a path within the molten electrolyte bath and reducing the metal oxide as the metal oxide powders and/or pellets move along the path, and continuously or semi-continuously removing reduced material from the molten electrolyte bath.

The term "powder and/or pellet form" is understood herein to mean particles having a particle size of 3.5 mm or less. The upper end of this particle size range covers particles that are usually described as pellets. The remainder of the particle size range covers particles that are usually described as powders.

Preferably the size of the particles is 2.5 mm or less.

The term "semi-continuously" is understood herein to mean that the process includes: (a) periods during which metal oxide powders and/or pellets are supplied to the cell and periods during which there is no such supply of metal oxide powders and/or pellets to the cell, and (b) periods during which reduced material is removed from the cell and periods during which there is no such removal of reduced material from the cell.

The overall intention of the use of the terms "continuously" and "semi-continuously" is to describe cell operation other than on a batch basis.

In this context, the term "batch" is understood to include situations in which metal oxide is continuously supplied to a cell and reduced material builds up in the cell until the end of a cell cycle, such as disclosed in International application WO 01/62996 in the name of The Secretary of State for Defence.

Preferably the process includes transporting the powders and/or pellets along the path within the molten electrolyte bath in direct contact with the cathode for at least a substantial part, typically at least 50 percent, of the path.

More preferably the process includes transporting the powders and/or pellets along the path within the molten electrolyte bath in direct contact with the cathode for at least 90 percent of the path.

Notwithstanding the above preference, the present invention extends to transporting the powders and/or pellets along the path within the molten electrolyte bath under conditions in which there is no direct contact for a substantial part of the path.

There are a large number of possible options for the path of movement of metal oxide powders and/or pellets within the molten electrolyte bath and the means of achieving the required movement.

By way of example, metal oxide powders and/or pellets may be supplied into the molten bath, typically from above the surface of the bath on one side of the bath, and be transported upwardly within the bath along an inclined upward path to a discharge outlet, typically at the other side of the bath.

The inclined upward movement may be achieved by means of a screw or other suitable transport means. Depending on the circumstances, the screw may be the cathode or the cathode may be spaced from the screw.

By way of further example, metal oxide powders and/or pellets may be supplied into the molten bath, typically from above the surface of the bath, and be transported downwardly through the bath to a discharge outlet at a lower end of the bath.

The downward movement may be achieved by means of a screw or other suitable transport means. Depending on the circumstances, the screw may be the cathode or the cathode may be spaced from the screw.

In a number of situations there may be issues relating to sealing the lower end of the molten bath that could make lower end discharge a significantly less preferred option than other options.

By way of further example, metal oxide powders and/or pellets may be supplied into the molten bath, typically from above the surface of the bath, and are transported in a continuous, preferably circular, path through the bath to a discharge outlet of the bath.

Preferably the metal oxide powders and/or pellets are supplied onto and transported by a cell cathode in the form of a horizontally disposed plate for supporting metal oxides that is supported for rotation about a vertical axis.

Preferably, in use, metal oxides in powder and/or pellet form are supplied continuously or semi-continuously onto an upper surface of the plate at a selected location on the path of movement of the plate around the axis and form a bed on the plate and move with the plate around the path and are electrochemically reduced as the plate moves around the path and are discharged continuously or semi-continuously from cell at another selected location on the path.

This rotating plate arrangement makes it possible to minimise the electrical current path length of the cathode and thereby minimise the resistance of the cathode and thereby maximise the current through the cathode. The applicant has realised that operating a cell with a high current is an important objective.

Accordingly, preferably the process includes the steps of: applying a cell potential across the anode and the cathode that is capable of electrochemically reducing metal oxide supplied to the molten electrolyte bath, continuously or semi-continuously feeding the metal oxide in powder and/or pellet form onto an upper surface of the cathode plate and forming a bed of powder and/or pellets, moving the cathode plate about the vertical axis and thereby transporting the metal oxide powders and/or pellets along a path around the axis within the molten electrolyte bath and electrochemically reducing the metal oxide, and continuously or semi-continuously discharging reduced material from the molten electrolyte bath.

In some situations it is preferred that the process includes maintaining the bed at a depth that is no more than twice the average diameter of the particles of the powders and/or pellets on the bed.

In other situations it is preferred that the process includes maintaining the bed at a depth that is more than 2 times the average diameter of the particles of the powders and/or pellets on the bed.

In these situations, preferably the process includes stirring the bed as the cathode plate moves and transports the powders and/or pellets along the path.

There are two main objectives in stirring the bed. One objective is to ensure that there is substantially uniform contact between the powders and/or pellets and the molten electrolyte and substantially uniform electrical contact between the powders and/or pellets and the cathode plate. Stirring the bed avoids an undesirable situation in which (a) the particles at the top of the bed have considerably greater exposure to molten electrolyte than particles at the bottom of the bed and (b) the particles at the bottom the bed have considerably greater electrical contact with the cathode plate than the particles at the top of the bed.

The bed may be stirred by any suitable means.

Suitable means include rakes having prongs that extend downwardly into the bed, selective heating of sections of the bath, and the use of evolved gases in the bath.

Preferably the prongs are electrically conductive and form part of the cathode current.

Preferably the process electrochemically reduces the metal oxide to reduced material in the form of metal having a concentration of oxygen that is no more than 0.2% by weight.

More preferably the concentration of oxygen is no more than 0.1% by weight.

The process may be a single or multiple stage process involving one or more than one electrochemical cell.

In the case of a multiple stage process involving more than one electrochemical cell, preferably the process includes successively passing reduced and partially reduced metal oxides from a first electrochemical cell through one or more than one downstream electrochemical cell and continuing reduction of the metal oxides in these cells.

Another option for a multiple stage process includes recirculating reduced and partially reduced metal oxides through the same electrochemical cell.

Preferably the process includes washing metal that is removed from the cell to separate electrolyte that is carried from the cell with the reduced material.

Preferably the process includes recovering electrolyte that is washed from the reduced material and recycling the electrolyte to the cell.

Alternatively, or in addition, the process includes supplying make-up electrolyte to the cell.

The anode and the cathode may be of any suitable types.

By way of example, the anode may be formed from graphite. In that event, the graphite may form at least part of the wall of the cell or be in the form of one or more blocks extending into the cell. Alternatively, the anode may be a molten metal anode in direct or indirect contact with the electrolyte.

Preferably the process includes maintaining the cell temperature below the vaporisation and/or decomposition temperatures of the electrolyte.

Preferably the process includes applying a cell potential above a decomposition potential of at least one constituent of the electrolyte.

In a situation in which the metal oxide is titania it is preferred that the electrolyte be a $CaCl_2$-based electrolyte that includes CaO as one of the constituents.

In such a situation it is preferred that the process includes maintaining the cell potential above the decomposition potential for CaO.

According to the present invention there is also provided an electrochemical cell for electrochemically reducing a metal oxide in a solid state, which electrochemical cell includes (a) a bath of a molten electrolyte, (b) a cathode, (c) an anode, (d) a means for applying a potential across the anode and the cathode, (e) a means for supplying metal oxide in powder and/or pellet form to the molten electrolyte bath, (f) a means for transporting metal oxide in powder and/or pellet form along a path within the molten electrolyte bath so that the metal oxide can be electrochemically reduced in the bath, and (g) a means for removing reduced material from the molten electrolyte bath.

Preferably the cathode is in the form of a horizontally disposed plate for supporting metal oxides that is immersed in the electrolyte bath and is supported for rotation about a vertical axis.

Preferably the means for transporting the metal oxide along the path within the bath includes a means for moving the cathode plate about the vertical axis.

Preferably the means for supplying metal oxide to the bath is adapted to supply the metal oxide powders and/or pellets onto an upper surface of the plate while the plate is rotating about the vertical axis to form a moving bed of powders and/or pellets on the upper surface.

Preferably the cathode plate is a circular plate.

Preferably the cathode includes a vertical shaft connected to and extending upwardly from the cathode plate and coincident with the vertical axis.

With this arrangement preferably the means for moving the cathode plate about the vertical axis supports the shaft for rotation about the vertical axis.

Preferably the support shaft is formed from an electrically conductive material and forms part of an electrical circuit that includes the cathode, the anode, and the means for applying the potential across the anode and the cathode.

Preferably the cell further includes a membrane that separates the cathode and the anode and is permeable to oxygen anions and is impermeable to dissolved metal in the electrolyte, and optionally is impermeable to any one or more of (i) electrolyte anions other that oxygen anions, (ii) anode metal cations, and (iii) any other ions and atoms.

Preferably the membrane is formed from a solid electrolyte.

The solid electrolyte may be yttria stabilised zirconia.

Preferably the anode extends downwardly into the electrolyte bath and is positioned a predetermined distance above the cathode plate.

In a situation in which the anode is a consumable anode, for example by being formed from graphite, preferably the cell includes a means for supporting and moving the anode downwardly into the electrolyte bath as the anode is consumed.

Preferably the supporting/moving means is operable to maintain the predetermined distance between the anode and the cathode.

Preferably the anode includes a plurality of anode blocks that extend radially of the vertical axis of the cathode plate.

Preferably the spacing between adjacent anode blocks is sufficient to allow gases evolved at the anode to escape from the electrolyte bath to minimise build-up of evolved gases around the anode blocks.

Preferably the cell includes a means for treating gases released from the cell.

The gas treatment means may include a means for removing any one or more of carbon dioxide, HCl, chlorine, and phosgene from the gases.

The gas treatment means may also include a means for combusting carbon monoxide gas in the gases.

In a situation in which the metal oxide is titania it is preferred that the electrolyte be a $CaCl_2$-based electrolyte that includes CaO as one of the constituents.

BRIEF DESCRIPTION OF THE DRAWING

The present invention is described further by way of example with reference to the accompanying drawings, of which.

DETAILED DESCRIPTION OF THE PREFERRED EMBODIMENTS

Figure 1:
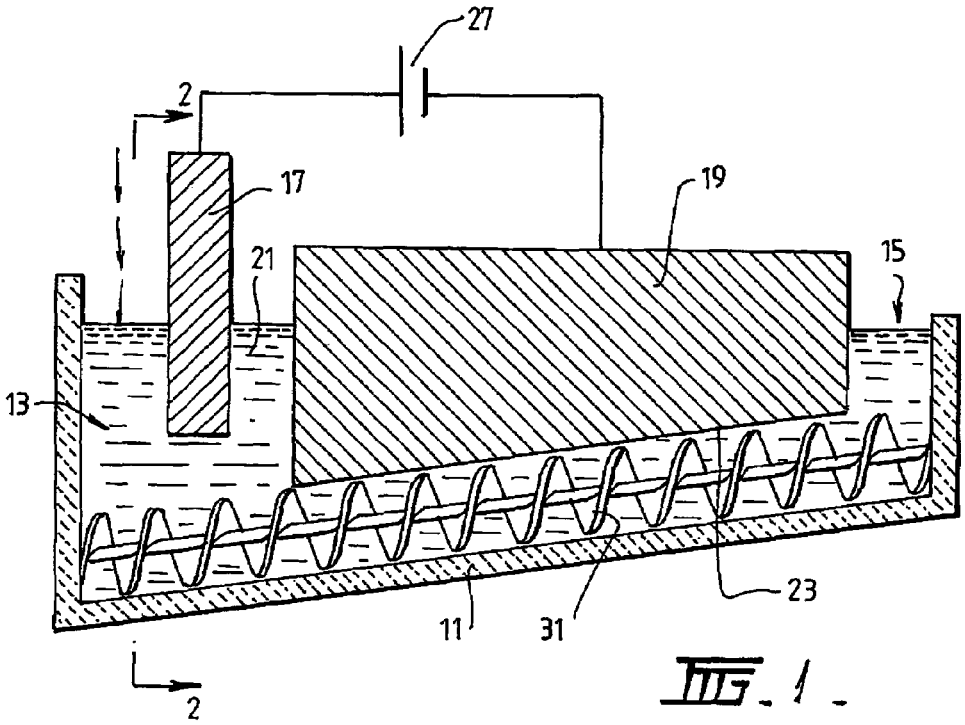
FIG. 1 is a vertical section of one embodiment of an electrochemical cell in accordance with the present invention.
Figure 2:
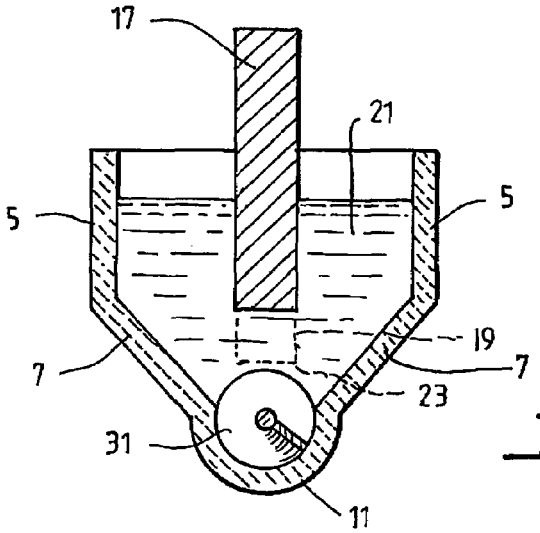
FIG. 2 is a section along the line 2-2 of FIG. 1.

The following description of the embodiment of the electrochemical cell shown in FIGS. 1 and 2 is in the context of electrochemically reducing powders and/or pellets of titania of less than 3.5 mm to titanium metal having a concentration of oxygen that is no more than 0.2% by weight.

The cell shown in FIGS. 1 and 2 is generally elongate. The cell includes upper vertical side wall sections 5 and lower downwardly and inwardly converging side wall sections 7. The cell also includes a semi-circular base section 11. The base section 11 is inclined upwardly from a metal oxide powder supply end 13 to a metal discharge end 15. The base section 11 is shaped to receive a screw 31 that is operable to transport metal powder along the inclined upward path from the supply end 13 to the discharge end 15.

The cell further includes a bath 21 of molten electrolyte.

The cell further includes an anode 17 located at the supply end 13 of the cell.

The cell further includes a cathode in the form of an elongate block 19 extending into the cell and the screw 31. The block 19 extends along the length of the cell and has an upwardly inclined lower wall 23 that has a constant spacing above the screw 31 and is electrically connected by means (not shown) to the screw 31.

The cell further includes a power source 27 for applying a potential across the anode and the cathode.

The electrolyte may be any suitable electrolyte. Suitable electrolytes include commercially available $CaCl_2$, namely calcium chloride dihydrate, and commercially available anhydrous $CaCl_2$ that produce very small amounts of CaO in the bath.

The anode 17 and the cathode block 19 may be formed from any suitable materials.

In use, the cell is positioned in a suitable furnace to maintain the electrolyte in a molten state.

The atmosphere around the cell is preferably an inert gas, such as argon, that does not react with the molten electrolyte.

Once the cell reaches its operating temperature, a preselected voltage is applied to the cell, metal oxide powders and/or pellets are then supplied to the cell on a continuous or a semi-continuous basis, and the screw 31 is actuated. In situations where the electrolyte is commercially available $CaCl_2$, preferably the cell is operated at a potential that is above the decomposition potential of CaO and is below the decomposition potential of $CaCl_2$. The metal oxide powders and/or pellets move downwardly to the base of the cell and are transported along the upwardly inclined base by the screw 31 and are reduced to metal as described above as the powders and/or pellets move along the inclined path. Metal powders and/or pellets and electrolyte that are retained in the pores of the metal powders and/or pellets are removed from the cell continuously or semi-continuously at the discharge end 15. The discharged material is cooled to a temperature that is below the solidification temperature of the electrolyte, whereby the electrolyte blocks direct exposure of the metal and thereby restricts oxidation of the metal. The discharged material is then washed to separate the retained electrolyte from the metal powder. The metal powder is thereafter processed as required to produce end products.

The above-described cell is capable of reducing metal oxide powders and/or pellets to low concentrations of oxygen, typically no more than 0.2 wt. %, in relatively short periods of time when compared with processing times required for larger pellets and larger blocks of metal oxides.

Figure 3:
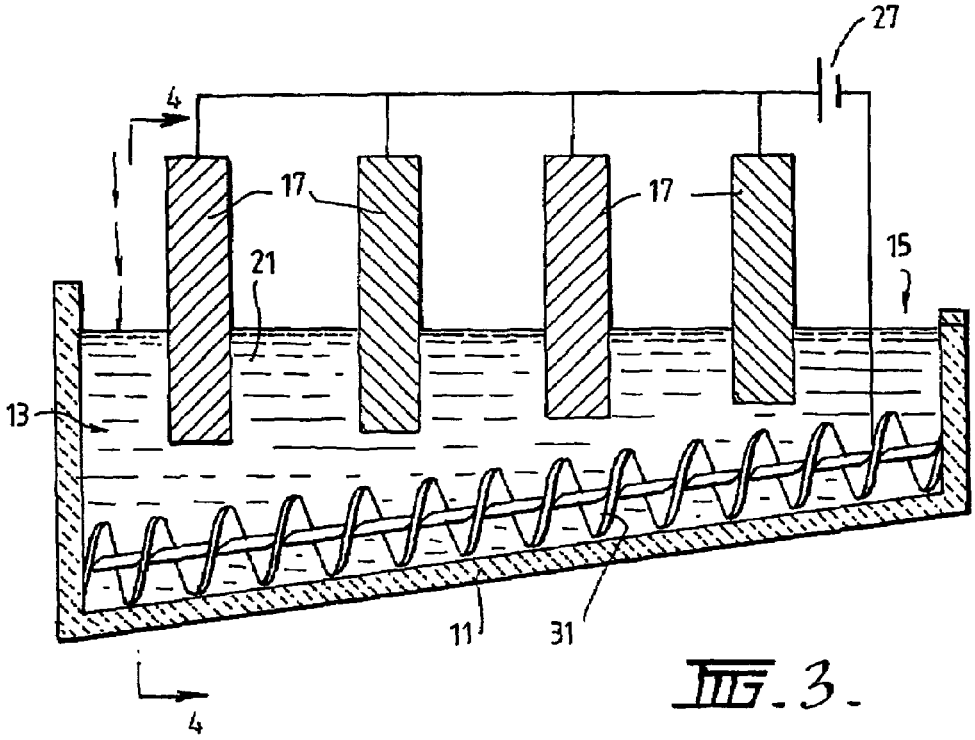
FIG. 3 is a vertical section of another embodiment of an electrochemical cell in accordance with the present invention.
Figure 4:
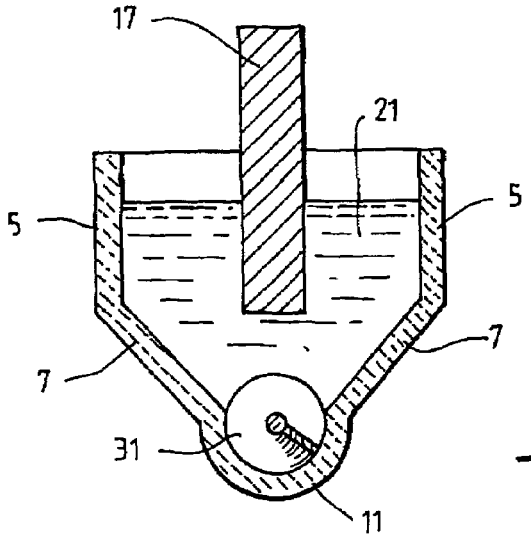
FIG. 4 is a section along the line 4-4 of FIG. 3.

The following description of the embodiment of the electrochemical cell shown in FIGS. 3 and 4 is in the context of electrochemically reducing powders and/or pellets of titania of less than 3.5 mm to titanium metal having a concentration of oxygen that is no more than 0.2% by weight.

The cell shown in FIGS. 3 and 4 is very similar in construction to the cell shown in FIGS. 1 and 2 and the basic operation of the cell is as described above in relation to the cell shown in FIGS. 1 and 2.

The main differences between the cells are that (a) the cell shown in FIGS. 3 and 4 does not include the cathode block 19 of the cell shown in FIGS. 1 and 2—the cathode comprises the screw 31 only—and (b) the cell shown in FIGS. 3 and 4 includes a plurality of anodes 17 at spaced intervals along the length of the cell rather than the single anode 17 positioned at the supply end only of the cell shown in FIGS. 1 and 2.

Figure 5:
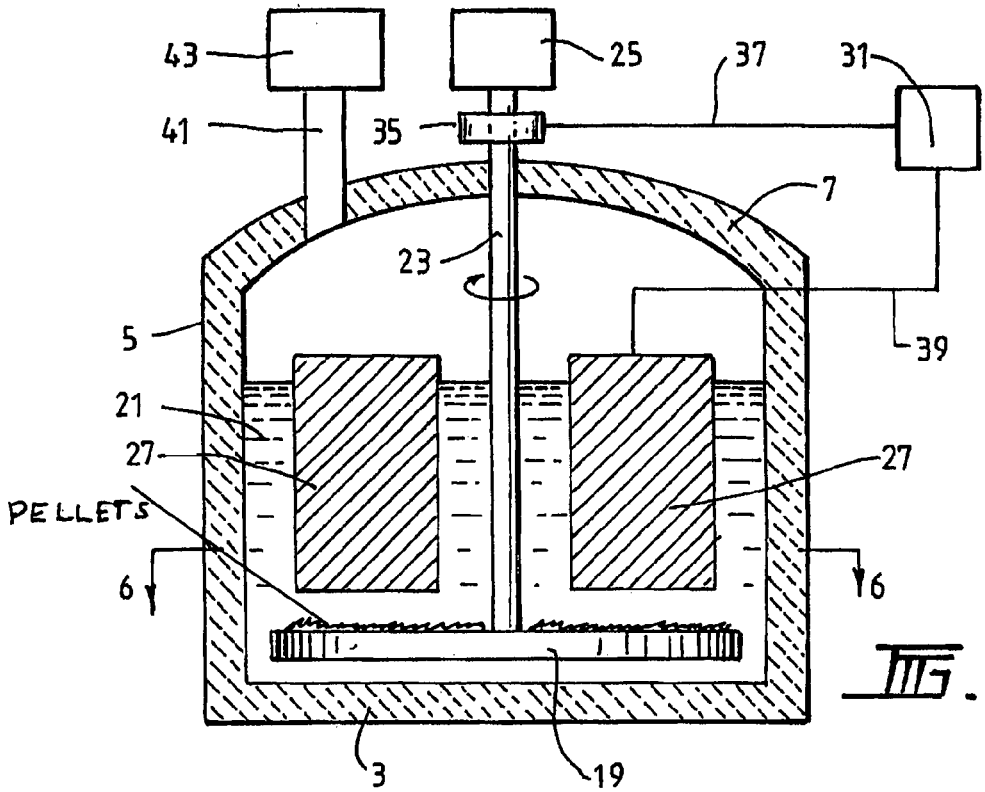
FIG. 5 is a vertical section of another embodiment of an electrochemical cell in accordance with the present invention.
Figure 6:
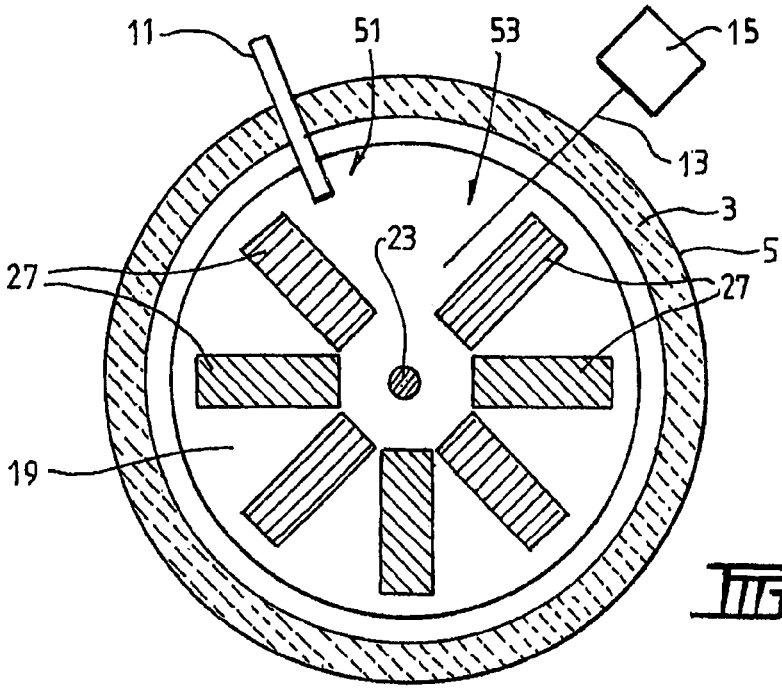
FIG. 6 is a section along the line 6-6 of FIG. 3.

The following description of the embodiment of the electrochemical cell shown in FIGS. 5 and 6 is in the context of electrochemically reducing pellets of 1-3 mm size of titania to titanium metal having a concentration of oxygen that is no more than 0.2% by weight.

The cell shown in FIGS. 5 and 6 has a base wall 3, a circular side wall 5 and a curved top wall 7. The walls 3, 5, 7 are formed from suitable insulating materials to minimise heat loss from the cell.

The cell further includes a bath 21 of molten electrolyte in the form of commercially available $CaCl_2$ that decomposes on heating and produces a very small amount of CaO in the bath.

The cell further includes a cathode in the form of a circular plate 19 that is horizontally disposed and immersed in the electrolyte bath 21 and a vertical shaft 23 connected to and extending upwardly from the centre of the cathode plate.

The cell further includes a means 25 for supporting the assembly of the cathode plate 19 and the shaft 23 in the cell as shown in the Figures and for rotating the assembly about the vertical axis of the shaft and the plate 19.

The cathode plate 19 forms a horizontal support surface for pellets of titania. The cell includes a vibratory feeder 11 or other suitable feeder for supplying the pellets continuously or semi-continuously onto the plate at one location 51 and an assembly of a rake 13 and a sump 15 for discharging pellets continuously or semi-continuously from the plate at another location 53. The operating conditions of the cell are selected and controlled so that the titania in the pellets on the cathode plate 19 is electrochemically reduced to titanium as the plate rotates between the supply and discharge locations 51, 53.

The cell further includes an anode in the form of an array of radially extending graphite blocks 27 that extend downwardly into the cell into the electrolyte bath 21 and are spaced a predetermined distance above an upper surface of the cathode plate 19. The distance is selected to be as small as possible given the physical constraints of the cell and the operating constraints of the process. The anode blocks 27 are drawn as rectangular blocks in the Figures. The anode blocks 27 are not limited to this shape and may be any suitable shape.

In use of the cell, the anode blocks 27 are progressively consumed by a reaction between carbon in the anode blocks 27 and $O^{--}$ anions generated at the cathode plate 19, and the reaction occurs predominantly at the lower edges of the anode blocks 27. It is preferred that the distance between the upper surface of the cathode plate 19 and the lower edges of the anode blocks 27 be maintained substantially constant in order to minimise changes that may be required to other operating parameters of the process. Consequently, the cell further includes a means (not shown) for progressively lowering the anode blocks into the electrolyte bath 21 to maintain the distance between the upper surface of the cathode plate 19 and the lower edges of the anode blocks 27 substantially constant.

The cell further includes a power source 31 for applying a potential across the anode blocks 27 and the cathode plate 19 and an electrical circuit that electrically interconnects the power source 31, the anode blocks 27, and the cathode plate 19.

Preferably the cell is operated at a potential that is above the decomposition potential of CaO and is below the decomposition potential of $CaCl_2$. Depending on the circumstances, the potential may be as high as 4-5V. In accordance with the above-described mechanism, operating above the decomposition potential of CaO facilitates deposition of Ca metal on the cathode plate 19 due to the presence of $Ca^{++}$ cations and migration of $O^{--}$ anions to the anode blocks as a consequence of the applied field and reaction of the $O^{--}$ anions with carbon of the anode blocks to generate carbon monoxide and carbon dioxide and release electrons. In addition, in accordance with the above-described mechanism, the deposition of Ca metal results in chemical reduction of titania via the mechanism described above and generates $O^{--}$ anions that migrate to the anode blocks 27 as a consequence of the applied field and further release of electrons. Operating the cell below the decomposition potential of $CaCl_2$ minimises evolution of chlorine gas, and is an advantage on this basis.

The vertical shaft 23 that is connected to the cathode plate 19 is arranged to be part of the electrical circuit. The vertical shaft 23 is formed from an electrically conductive material and is electrically connected to the power source 31 via an assembly 35 of a copper collar and contact brushes and a busbar 37.

Each anode block 27 is connected to the power source 31 via a series of busbars 39 (only one of which is shown in FIG. 1).

As is indicated above, the operation of the cell generates carbon dioxide and potentially chlorine gas at the anode and it is important to remove these gases from the cell. The spaces between anode blocks 27 facilitate release of evolved gases from the electrolyte bath. The cell further includes an off-gas duct 41 in the roof 7 of the cell and a gas treatment unit 43 that treats the off-gases before releasing the treated gases to atmosphere. The gas treatment includes scrubbing to remove carbon dioxide and any chlorine gases and may also include combusting carbon monoxide to generate heat for the process.

Titanium pellets and electrolyte that is retained in the pores of the titanium pellets are removed from the cell continuously or semi-continuously at the discharge location 53. The discharged material is cooled to a temperature that is below the solidification temperature of the electrolyte, whereby the electrolyte blocks direct exposure of the metal and thereby restricts oxidation of the metal. The discharged material is then washed to separate the retained electrolyte from the metal powder. The metal powder is thereafter processed as required to produce end products.

The above-described cells and process are an efficient and an effective means of continuously and semi-continuously electrochemically reducing metal oxides in the form of powders and/or pellets to produce metal having a low oxygen concentration.

Many modifications may be made to the embodiments of the present invention described above without departing from the spirit and scope of the invention.

Specifically, the electrochemical cells shown in the Figures are three examples only of a large number of possible cell configurations that are within the scope of the present invention.

In addition, whilst the embodiment shown in FIGS. 5 and 6 includes an anode in the form of a plurality of anode blocks 27, the present invention is not so limited and extends to other arrangements. One such other arrangement is in the form of a single anode block that substantially covers the cathode plate 19 and is porous to facilitate the escape of evolved gases from the cell.

In addition, whilst it is preferred that the above-described cells be operated at potentials up to the decomposition potential of $CaCl_2$, the present invention extends to operating at higher potentials.

In addition, whilst the embodiments are described in the context of electrochemically reducing titania, the present invention is not so limited and extends to electrochemically reducing other suitable metal oxides.

What is claimed is:

1. A process for electrochemically reducing a metal oxide, in a solid state in an electrochemical cell that includes a bath of molten electrolyte, a cathode, and an anode, which process includes the steps of:

applying a cell potential across the anode and the cathode that is capable of electrochemically reducing metal oxide supplied to the molten electrolyte bath, continuously or semi-continuously feeding the metal oxide in powder and/or pellet form into the molten electrolyte bath, transporting the powders and/or pellets along a path within the molten electrolyte bath in direct contact with the cathode for at least a substantial part of the path and reducing the metal oxide as the metal oxide powders and/or pellets move along the path, and continuously or semi-continuously removing metal from the molten electrolyte bath, wherein the metal oxide is titania, and the electrolyte is a CaCl2-based electrolyte that includes CaO as one of the constituents, and wherein the substantial part of the path is at least fifty percent of the path.

2. The process defined in claim 1 including transporting the powders and/or pellets upwardly along an inclined upward path within the bath to a discharge outlet of the bath.

3. The process defined in claim 1 including transporting the powders and/or pellets downwardly through the bath to a discharge outlet at a lower end of the bath.

4. The process defined in claim 1 including transporting the powders and/or pellets in a continuous path through the bath to a discharge outlet of the bath.

5. The process defined in claim 4 wherein the continuous path is a circular path.

6. The process defined in claim 1 including transporting the metal oxide powders and/or pellets on a cell cathode in the form of a horizontally disposed plate for supporting metal oxides that is supported for rotation about a vertical axis.

7. The process defined in claim 5 including supplying metal oxide powders and/or pellets continuously or semi-continuously onto an upper surface of the plate at a selected location on a path of movement of the plate around the axis and forming a bed on the plate and moving the plate and transporting the powders and/or pellets around the path and electrochemically reducing the metal oxides as the plate moves around the path and discharging reduced metal oxides continuously or semi-continuously from the cell at another selected location on the path.

8. The process defined in claim 6 including maintaining the bed at a depth that is no more than twice the average diameter of the individual particles of the powders and/or pellets on the bed.

9. The process defined in claim 6 including maintaining the bed at a depth that is more than two times the average diameter of the individual particles of the powders and/or pellets on the bed.

10. The process defined in claim 6 including stirring the bed as the cathode plate moves and transports the powders and/or pellets along the path.

11. The process defined in claim 1 including electrochemically reducing the metal oxide to reduced material in the form of metal having a concentration of oxygen that is no more than 0.2% by weight.

12. The process defined in claim 1 including multiple stages involving more than one electrochemical cell and including successively passing reduced and partially reduced metal oxides from a first electrochemical cell through one or more than one downstream electrochemical cell and continuing reduction of the metal oxides in this cell or cells.

13. The process defined in claim 1 including multiple stages including recirculating reduced and partially reduced metal oxides through the same electrochemical cell.

14. The process defined in claim 1 including washing reduced material that is removed from the cell to separate electrolyte that is carried from the cell with the reduced material.

15. The process defined in claim 13 including recovering electrolyte that is washed from the reduced material and recycling the electrolyte to the cell.

16. The process defined in claim 13 including supplying make-up electrolyte to the cell.

17. The process defined in claim 1 including maintaining the cell temperature below the vaporisation and/or decomposition temperatures of the electrolyte.

18. The process defined in claim 1 including applying a cell potential above a decomposition potential of at least one constituent of the electrolyte.

19. The process defined in claim 1, wherein the transporting of the powders and/or pellets along a path within the molten electrolyte bath in direct contact with the cathode for at least a substantial part of the path includes continuously transporting the powders and/or pellets along the path.

20. The process defined in claim 1, wherein an apparatus to transport the powders and/or pellets along the path is arranged to transport the powders and/or pellets along substantially the entire path.

21. The process defined in claim 1, wherein the substantial part of the path is between the cathode and an apparatus to transport the powders and/or pellets along the path.

22. The process defined in claim 1, wherein the electrochemical cell consists of a single anode and a single cathode.

* * * * *

UNITED STATES PATENT AND TRADEMARK OFFICE

CERTIFICATE OF CORRECTION

PATENT NO. : 7,470,355 B2
APPLICATION NO. : 10/490452
DATED : December 30, 2008
INVENTOR(S) : Steve Osborn et al.

It is certified that error appears in the above-identified patent and that said Letters Patent is hereby corrected as shown below:

Column 10 – Line 13, replace “claim 5” with --claim 6--.

Column 10 – Line 23, replace “claim 6” with --claim 7--.

Column 10 – Line 28, replace “claim 6” with --claim 7--.

Column 10 – Line 32, replace “claim 6” with --claim 7--.

Column 10 – Line 53, replace “claim 13” with --claim 14--.

Column 10 – Line 56, replace “claim 13” with --claim 14--.

Signed and Sealed this

Thirty-first Day of March, 2009

John Doll

JOHN DOLL
*Acting Director of the United States Patent and Trademark Office*